United States Patent [19]

Ishikawa

[11] Patent Number: 4,986,579

[45] Date of Patent: Jan. 22, 1991

[54] DOOR CLOSING DEVICE

[75] Inventor: Yoshiaki Ishikawa, Chiryu, Japan

[73] Assignee: Aisin Seiki Kabushiki Kaisha, Kariya, Japan

[21] Appl. No.: 415,768

[22] Filed: Oct. 2, 1989

[30] Foreign Application Priority Data

Sep. 30, 1988 [JP] Japan ..... 63-248475

[51] Int. Cl.[5] ..... E05C 3/26

[52] U.S. Cl. ..... 292/201; 292/216; 292/DIG. 73

[58] Field of Search ..... 292/201, 216, DIG. 23, 292/DIG. 65, DIG. 38, 341.16

[56] References Cited

U.S. PATENT DOCUMENTS 4,364,249 12/1982 Kleefeldt ..... 292/201 X
4,382,622 5/1983 Ishikawa ..... 292/DIG. 39 X
4,569,544 2/1986 Escaravage ..... 292/201 X
4,588,217 5/1986 Escaravage ..... 292/216 X
4,616,862 10/1986 Ward ..... 292/DIG. 27 X
4,763,936 8/1988 Rogakos et al. ..... 292/201

*Primary Examiner*—Eric K. Nicholson
*Attorney, Agent, or Firm*—Burns, Doane, Swecker & Mathis

[57] ABSTRACT

A vehicle door may sometime be positioned in a half-latched condition for bringing the door from this condition to a fully latched condition, a door closing device is actuated in such manner that a pawl is rotated by a motor so as to be fully engaged with a striker. Due to this rotation of the pawl, the door is also rotated towards the body. If a portion of material or other objects are unfortunately put between the body and the rotating the door, the transmission of the driving force from the motor to the pawl through a first member and a second member can be interrupted by actuating an inside-handle (an outside-handle) which is operatively connected to the first member. Thus, further movement of the door is prevented, thereby preventing further damage of the material or injury of the other objects.

6 Claims, 6 Drawing Sheets

DOOR CLOSING DEVICE

BACKGROUND OF THE INVENTION

1. Field of the Invention

The present invention relates to a door closing device.

2. Description of the Related Art

In an automotive vehicle, a door closing device is equipped so as to bring a door from its half-latched condition to its full-latched condition. The door closing device is disclosed in Japanese Patent Laid-open Print No. 58-191884, for example, which is published without examination in 1983. In this device, an electro-magnetic clutch is interposed between the door and a driving source such as a solenoid and is pushed down for interrupting the movement of the door towards its full-latched condition when a portion of cloth such as clothing is held between the door and a vehicle-body from the standpoint of safety.

However, the employment of the electo-magnetic clutch brings the complexity of a control system for the door closing device. Also, it is cumbersome work to install the electro-magnetic clutch, which is relatively large in mass, in a narrow space within the door.

SUMMARY OF THE INVENTION

Accordingly, it is an object of the present invention to provide a door closing device without the aforementioned drawbacks.

It is another object of the present invention to provide a door closing device which is obtained without use of the electro-magnetic clutch.

These and other objects are achieved by a door closing device which is comprised of a latch mechanism provided between a door and a body and including a striker secured to the body and a pawl provided on the door; and a transmitting mechanism including a first member to be operated by a driver element, a second member engageable with the first member and actuating the pawl for closing the door upon engagement with the first member, and a cancel lever for releasing the engagement between the first and the second members.

DETAILED DESCRIPTION OF THE INVENTION

Figure 1:
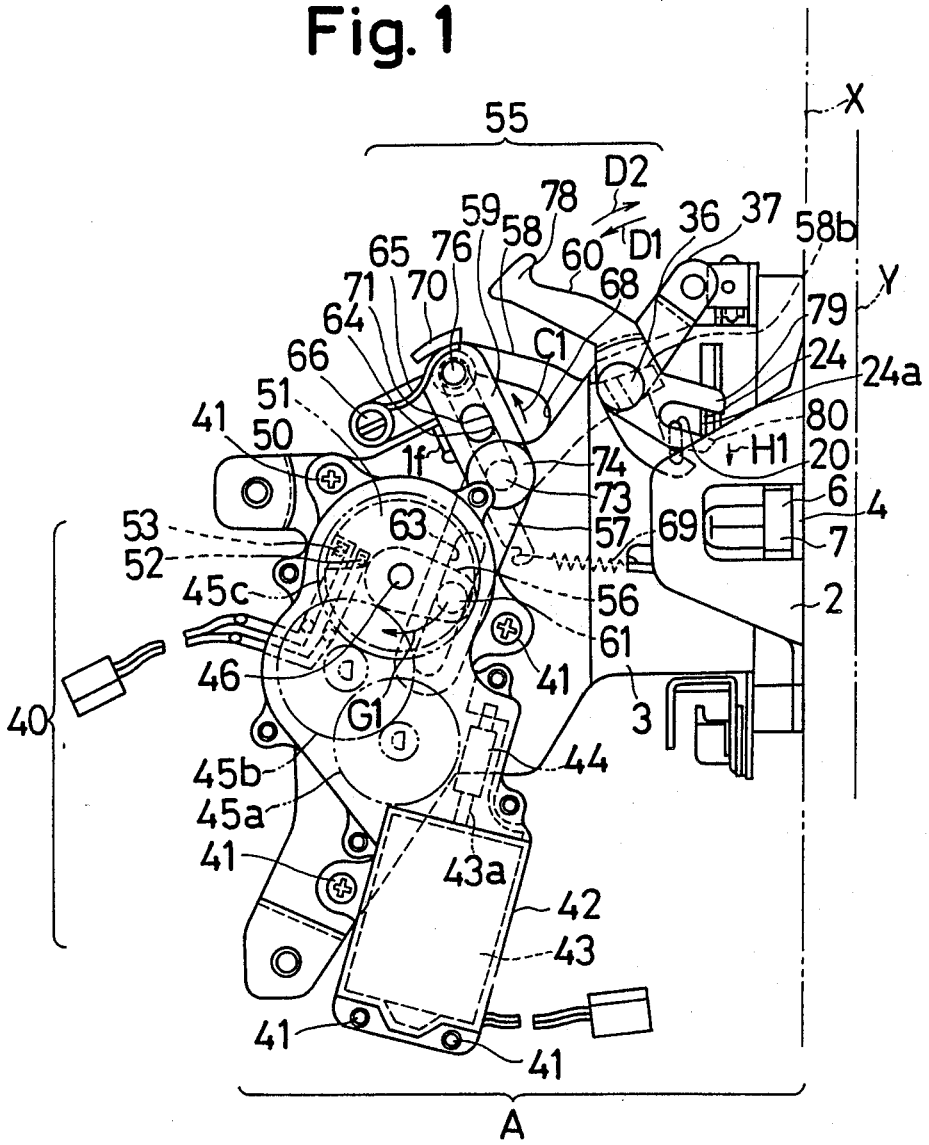
FIG. 1 is a side view of a door closing device of a first embodiment according to the present invention.

Referring first to FIG. 1, a door lock device (A) is installed to a door (X) and has a main base 2 and a sub base 3. As seen from FIG. 3, the door lock device (A) is provided with a hole or opening 5 to be engaged with an inner panel (not shown) of the door (X). The door lock device (A) has also a latch mechanism 6.

Figure 2:
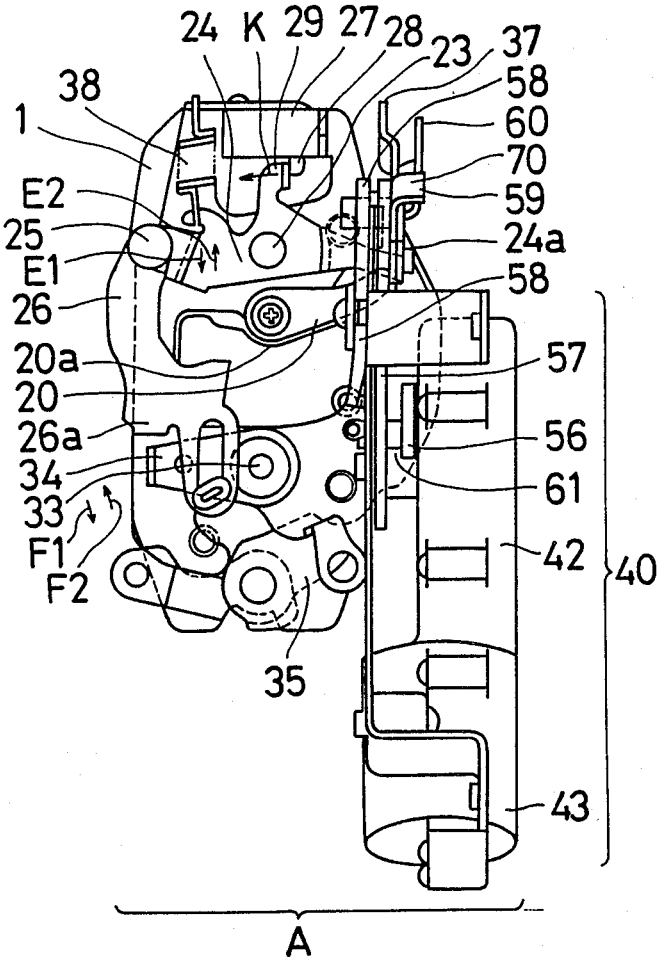
FIG. 2 is another side view of the door closing device in FIG. 1.
Figure 3:
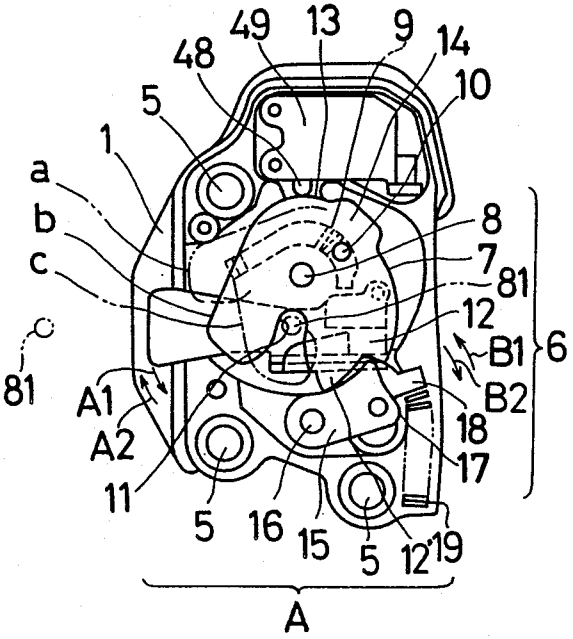
FIG. 3 is a view which shows mainly a latch mechanism.

The latch mechanism 6, as best shown in FIG. 3, includes a latch 7 which is rotatably mounted on a pin 8 of the door lock device (A). A return spring 9, accommodated within a groove in the device (A), biases continually a pin 10 of the latch, thereby urging the latch 7 in the direction of the arrow indicated by A2. The latch 7 has a U-shaped groove 11, two pawls 12 and 12′ of different configurations, a cam surface 13 and a cam-surface 14. The door lock device (A) includes a pin 16 on which a pawl 15 is mounted so as to be rotatable in both directions as indicated by arrows B1 and B2. The pawl 15 has a hook 17 and a projection 18. Between the door lock device (A) and the pawl 15, there is interposed a return spring 19 for urging the pawl 15 in the direction of B1. It should be noted that a position of the latch 7 shown in two-dotted line indicated by (a) is obtained when the door (X) is opened, a full-latched position of the latch 7 shown in two-dotted line indicated by (c) is obtained when the door (X) is fully closed and a half-latched position of the latch 7 shown in real line indicated by (b) is obtained when the door 99 is half closed in FIG. 3. As apparent from FIG. 2, a latch-lever 20 is connected via pin 20*a* for unitary rotation with the latch 7.

As shown in FIG. 2, on a pin 23 secured to the sub base 3, an open-lever 24 which is common to an inside door handle (not shown) and an outside door handle (not shown) is mounted so as to be rotatable in the direction of the arrows E1 and E2. The openlever 24 is connected to an open-link 26 via a pin 25. Further, a switch 27 for turning off a motor 43 in an emergency and a knob 28 can be pushed by a projection 29 of the open-lever 24. In addition, a lift-lever 34 is pivoted to the sub-base 3 via a pin 33 so as to be rotatable thereabout in the direction of the arrows F1 and F2. The lift-lever 34 is movable together with the pawl 15. The sub-base 3 is secured with a locking-lever 35.

As shown in FIG. 1, an inside-lever 37 is rotatably mounted on the sub-base 3 via a pin 36 and is operatively connected to the inside door handle via a wire (not shown). When the inside door-handle is operated for opening the door 99, rotation of the inside lever 37 about the pin 3 brings about the rotation of the open-lever 24 against a return-spring 38 about the pin 23 in the direction of the arrow E1. Thereby, open-link 26 is moved in the downward direction with the result that the lift-lever 34 is rotated about the pin 33 in the direction of the arrow F1. Thus, the pawl 15 which is in unitary rotation with the lift-lever 34 is rotated, as shown in FIG. 3, in the direction of the arrow B2 against the return-spring 19. The hook 17 of the pawl 15 is removed from the pawls 12 and 12′. The latch 7 is rotated in the direction of the arrow A2 due to the biasing force of the return-spring 9, and the latch 7 is brought into the position shown in two-dotted line (a) in FIG. 3 under which the door 99 is in the opened position. Similar condition can be obtained by manipulation of the outside-handle.

Next, a driving mechanism 40 will be described in detail with reference to FIG. 1. The driving mechanism 40 includes a cover 42 secure to the sub-base by a bolt 41, a motor 43 accommodated with the cover 43, a worm 44 secured on a shaft 43*a* of the motor 43, gears 45*a*–45*c* defining a speed reducer and a shaft 46 driven by the gear 43*c*. As shown in FIG. 3, the door lock device 98 has a switch 49 with a knob 48. When the knob 48 is pushed down by the cam-surface 13 of the latch 7, the switch 49 is closed, thereby turning on the motor 43.

In this embodiment, the motor 43 is turned off after one rotation of the gear 45*c*. A conductive plate 51 is provided with a notch 50 and brushes 52 and 53. The conductive-plate 51 is rotated by the shaft 46. As shown in FIG. 1, while the motor 43 is not operational, the brush 52 is in contact with the conductive-plate 51, the brush 53 is not in contact with the conductive-plate 51 due to the opposed relationship between the brush 53 and the notch 50. After one rotation of the conductive-plate 51 together with the motor 43 as a result of the closure of the switch 49 by the actuation of the knob 48, the opposed relationship between the brush 53 and the notch 50 is again attained, thereby the motor 43 is turned off automatically.

Figure 11:
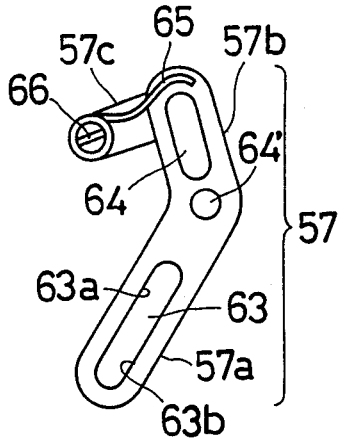
FIG. 11 is a side view of the active-lever.
Figure 13:
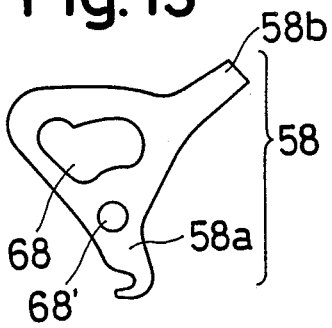
FIG. 13 is a side view of a passive-lever.

A transmitting mechanism 55, as shown in FIG. 1, includes an active-lever 57 as a first member, a push-lever 58 and a slide-lever 59 both of which are treated as a second member, and a cancel-lever 60. A cam-lever 56 having a rounded projection 61 is mounted on a distal end of the shaft 46. As shown in FIG. 11, the active-lever 57 includes a first portion 57*a* having a slot 63 with a pair of opposed walls 63*a* and 63*b*, a second portion 57*b* with a slot 64 and a third portion 57*c* to which a return spring 65 in the form of a wire is connected by a pin 66. As apparent from FIG. 1, the projection 61 of the camlever 56 is in sliding engagement with the slot 63 of the active-lever 57. As shown in FIG. 13, the push-lever 58 has a triangle portion 58*a* and a projection 58*b* extended therefrom. An irregular shaped aperture 68 is provided in the triangle portion 58*a* of the push-lever 58. As shown in FIG. 1, a return spring 69 is disposed between the push-lever 58 and the sub-base 3.

Figure 4:
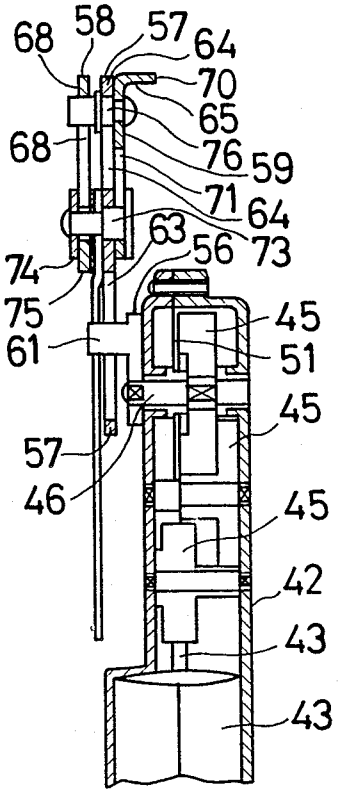
FIG. 4 through FIG. 7 are views for illustrating an operation of the door closing device in FIG. 1.
Figure 12:
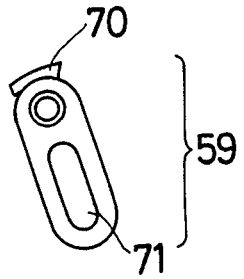
FIG. 12 is a side view of a slide-lever.

In FIG. 12, the slide-lever 59 has a bent portion 70 and a slot 71. As shown in FIG. 1, the return spring 65 urges continually the bent portion 70 so that the slide-lever 59 is urged in the direction of arrow Cl. As shown in FIG. 4, the slot 71 of the slide-lever 59, the slot 64 of the active-lever 64 and the slot 68 of the push-lever 58 are rotably mounted on a common pin 73. An engaging pin 76 is secured on the slide-lever 59 and can be movable within the aperture 68 of the push-lever 59 after sliding along the slots 71 and 64. In this embodiment, as shown in FIG. 4, the active-lever 57, the push-lever 58 and the slide-lever 59 are stacked in turn by the pins 73 and 76. Force applied to the active-lever 57 is transmitted to the push-lever 58 through the engaging pin 76 which rotates about the pin 73.

As shown in FIG. 1, the cancel-lever 60 is mounted on the pin 36 secured to the sub-base 3 so as to be rotatable in the direction of arrows D1 and D2. The cancel lever 60 is provided at one end (the other end) thereof with a portion 78 (a projection 79 and a projection 80 between which a projection 24*a* of the open-lever is located). Thus, upon the foregoing operation of the open-lever 24, the cancel lever is rotated in either of the direction of arrows D1 and D2. Numeral 1*f* denotes a stopper for the push-lever 58.

In operation for closing the door 99 in manual mode, as shown in FIG. 3, the striker 81 is moved into the U-shaped groove 11 of the latch 7 which is located at a position shown in two-dotted line (a) by the urging force of the return spring 90, as the door 99 is being closed. The latch 7 under the push from the striker 81 is rotated about the pin 8 in the direction of arrow A1 and the pawl 12 of the latch 7 is brought into engagement with the projection 17 of the pawl 15. Under resulting engagement, the latch 7 is in full-latched position as shown in two-dotted line (c) in FIG. 3. Thus, the door 99 is held at its fully closed condition. During the foregoing manual operation for closing the door 99, the knob 48 of the switch 49 is operated twice in turn by the cam-surfaces 13 and 14, thereby holding the opened condition of the switch 49. The motor 43 cannot be driven, thereby preventing the operations of the cam-lever 56, the active-lever 57 and the push-lever 58. Of course, the opened condition of the switch 49 is similarly maintained during the opening movement of the door 99.

Figure 5:
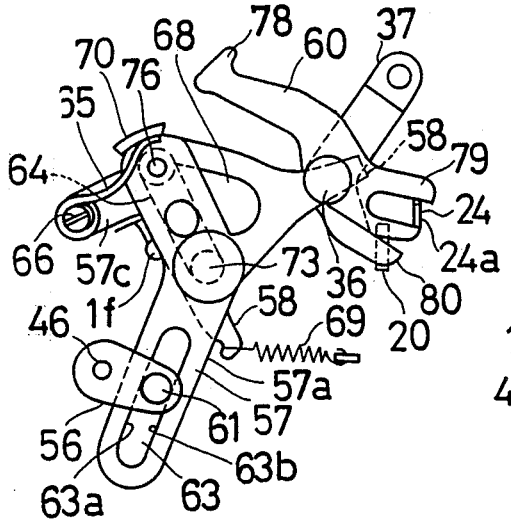
Figure 6:
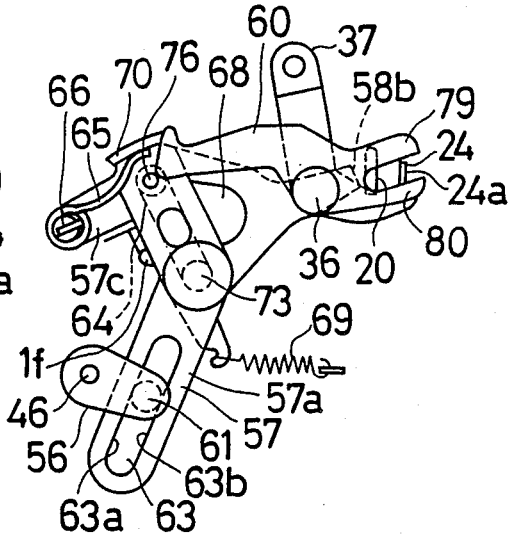
Figure 7:
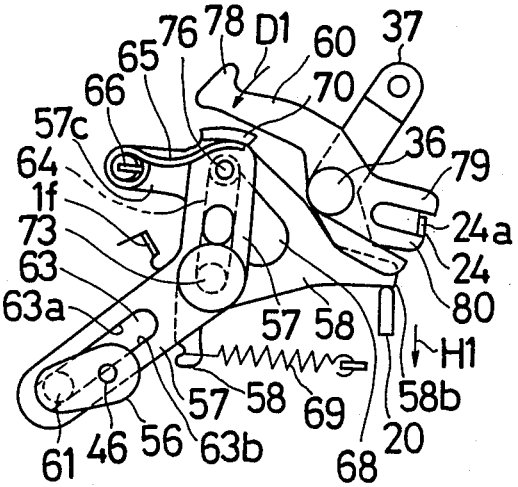

In case of the half-latched condition of the door 99 which occurs due to insufficient force for moving the door 99 in the closed condition thereof, the latch 7 is located at a position shown in two-dotted line (b) in FIG. 3 and the cam-surface 13 of the latch 7 pushes the knob 48 of the switch 49, thereby closing the switch 49. Then, the motor 43 is turned on and the rotating torque therefrom is transmitted to the shaft 46 via the worm 41 and gears 45*a*–45*c*. Thus, the cam-lever 56 is rotated about the shaft 46 in the direction of arrow G1. Since the rounded-projection 61 of the cam-lever 56 is in sliding engagement with the slot 63, the active-lever 57 is operated as if the pin 76 is rotated about the pin 73. Thus, as shown in FIG. 7, the push-lever 58 when pushed by the pin 76 begins to operate by pulling the return spring 69 and the projection 58*b* of the push-lever 58 moves the latch-lever 20 in the direction of arrow H1 as shown in FIG. 5. As a result, the latch 7 which moves together with the latch-lever 20 is rotated about the pin 8 in the direction of arrow A1. Due to the rotating latch 7, the door 99 is forced to be moved towards the vehicle body, thereby closing the door 99 fully. As mentioned previously, the motor 43 is turned off after one-rotation of the gear 45*c*. Thus, when the door 99 is brought into fully-closed condition, the motor 43 is automatically turned off and the operation of the push-lever 58 is stopped. The cam-lever 56 is returned to its original position when the motor 43 is not turned on.

Figure 8:
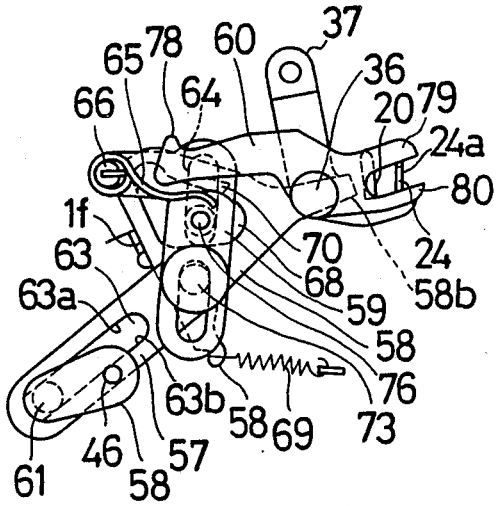
FIG. 8 shows an operation of a cancel lever.

Sometimes, a portion of material or other objects such as a finger is between the vehicle-body (B) and the door (X) during automatical movement thereof from the half-latched condition to fully-latched condition. In such case automatic movement of the door 99 has to be stopped. For this purpose, the inside-handle or the outside-handle is operated. In detail, upon actuation of the inside-handle, the inside-lever 37 connected thereto is operated, thereby rotating the open-lever 24 about the pin 23 in the direction of arrow E1. Upon actuation of the outside-handle, the open-lever 24 makes a similar operation. As a consequence, as shown in FIG. 7, the cancel-lever 60 is rotated about the pin 36 in the direction of arrow D1 due to the contact of the projection 24*a* of the open-lever 24 with the projection 79 of the cancel-lever 60. Thus, as shown in FIG. 8, the portion 78 of the cancel-lever 60 pushes the bent portion 70 of the slide-lever 59. The slide-lever 59 then slides downwards along the slot 64 against the return spring 65 and the pin 76 is displaced from the aperture 68 of the push-lever 58. Since the pin 76 under rotation serves for transmitting the force from the active-lever 57 to the push-lever 58, the pin 76 under the resulting condition disconnects the active-lever 57 and the push-lever 58.

Due to the rotation of the open-lever 24 about the pin 23 in the direction of arrow E1, the projection 29 of the open-lever 24 is moved in the direction of arrow K with the result that the emergency switch 27 is closed. Thus, the motor 43 is turned off, thereby stopping the automatic movement of the door 99 towards its fully-latched condition.

As a result of the rotation of the open-lever 24 in the direction of arrow E1, the downward movement of the open-link 26 as mentioned above rotates the lift-lever 34 about the pin 33 in the direction of arrow F1, thereby rotating the pawl 15. Thereafter, the projection 17 of the pawl 15 is removed from the pawl 12 of the latch 7 with the result that due to the biasing force of the returning spring 9, the latch 7 is transferred to a position shown in two dotted line (a) after its rotation about the pin 8 in the direction of arrow A2. Under such condition, if the door 99 is pulled for opening, engagement between the U-shaped groove 11 of the latch 7 and the striker 81 of the body Y is fully released, thereby bringing the door 99 relative to the body Y.

In case of the movement of the pin 76 into the aperture 68 of the push-lever 58, the biasing force of the return spring 65 to the bent portion 70 is continued, thereby returning the slide-lever 59 to its original position along the slot 64 of the active-lever 57 and the biasing force of the return spring 69 brings the passive-lever 58 to its original position. Thus, the passive-lever 58, the active-lever 57, the slide-lever 59 and the pin 76 are, as shown in FIG. 1, reset or returned to their original positions.

Figure 9:
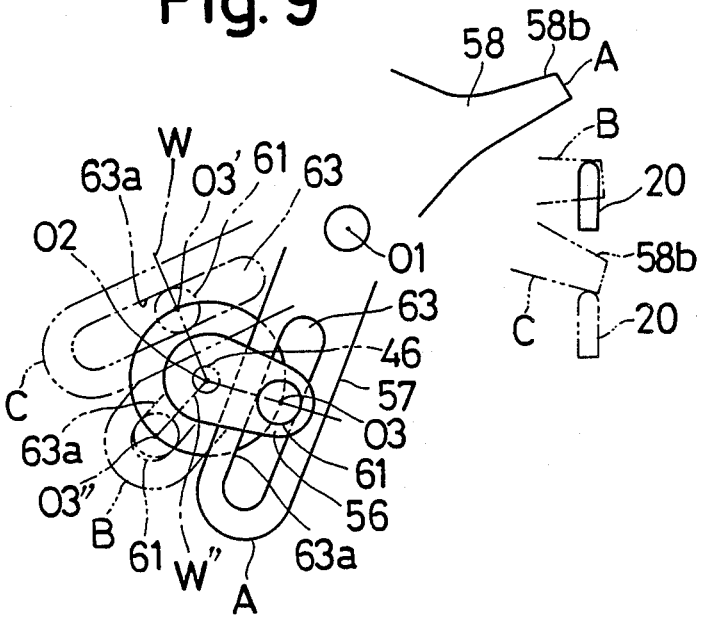
FIG. 9 shows a portion around a cam-lever in detail.

It is well-known that a weather-strip made of rubber or other elastomeric material is located between the door (X) and the body Y and is compressed by the door (X) in the course of movement to be closed. In light of this fact, during the closing operation of the door 99, a reacting force for opening the door 99 is applied to the door 99 and the door locking device 98. The reacting force is increased as the door 99 approaches the closed condition thereof. In FIG. 9, a symbol 01 denotes a rotating center of the active-lever 57, a symbol 02 denotes a rotating center of the shaft 46, a symbol 03 denotes a rotating center of the projection 61 of the active-lever 57, a symbol A denotes a position at which the active-lever 57 and the cam-lever 56 are stopped, a symbol C denotes a position under which the door (X) is in fully latched condition, and a symbol B denotes an intermediate point of a line obtained by connecting the points 01 and 02. The foregoing reacting force begins to apply to the door (X) when it comes to the half-latched position which is located at an intermediate position between the positions A and B. The magnitude of the reacting force is increased as the door (X) approaches its fully-latched position. Thus, as shown in FIG. 10, due to this reacting force, a load N is applied to the active-lever 57 as its rotating resistance from a half-latched position to fully latched position.

Figure 10:
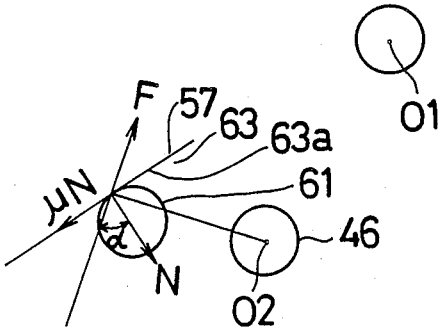
FIG. 10 shows a condition wherein force is applied to the cam lever and a active-lever.

In FIG. 10, relationship is illustrated between the load N, a sliding frictional force $\mu N$ generated between the projection 61 and the side-wall 63*a* of the slot 63 in the active-lever 57 and a load-torque F applied to the shaft 46. The following equation is obtained:

$$F=(N\cos\alpha+\mu N\sin\alpha)$$

where $\alpha$ is an angle defined between a present position of the active lever 57 and the position of the active-lever when the door (X) is in the half-latched condition. Table shows an example of the foregoing relationship. It is noted that $\mu=0.2$ in this table.

| N | 10 | 10 | 10 | 10 | 10 | 10 | 10 |
|---|---|---|---|---|---|---|---|
| α (degree) | 0 | 15 | 30 | 45 | 60 | 75 | 90 |
| Force | | | | | | | |
| ① Ncosα (Kg) | 10 | 14.5 | 17.3 | 17.7 | 15 | 12.9 | 0 |
| ② μNsinα (Kg) | 0 | 0.8 | 2 | 3.5 | 5.2 | 9.7 | 14 |
| ③ F = 1 + 2 (Kg) (Kg) | 10 | 15.3 | 19.3 | 21.2 | 20.2 | 22.6 | 14 |

According to this table, despite the increasing of the reacting force to the door (X) or the lever-load N, the load-torque F applied to the shaft 46 is decreased when the door (X) is at its fully-latched position. As apparent from FIG. 9, a line W obtained by connecting two points 02 and 03 is substantially perpendicular to the side-wall 63*a* of the slot 63 in the active-lever 57 when the door (X) is at its fully-latched position. This means that the motor 43 may be of low power.

Figure 14:
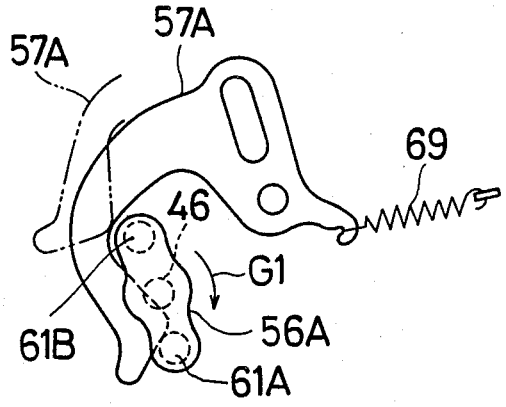
FIG. 14 is a side view of a door closing device of a second embodiment in a first position according to the present invention.

In the foregoing embodiment, the door (X) is closed fully after one rotation of the cam-lever 56 about the shaft 46. Instead of which, as shown in FIG. 14, the door (X) can be closed fully after a half portion of cam-lever 56 about the shaft 46. In this second embodiment, the rotation of the shaft 46 moves the cam-lever 56 in the direction of arrow G1, thereby moving the active-lever 57A to a two-dotted position. Thereafter, the active-lever 57A is returned to its original position by the actuation of the return spring 69. The projection 61A of the cam-lever 56A is stopped at a position 61B after a half rotation thereof. In this embodiment, the side-wall 63*b* is not required.

Figure 15:
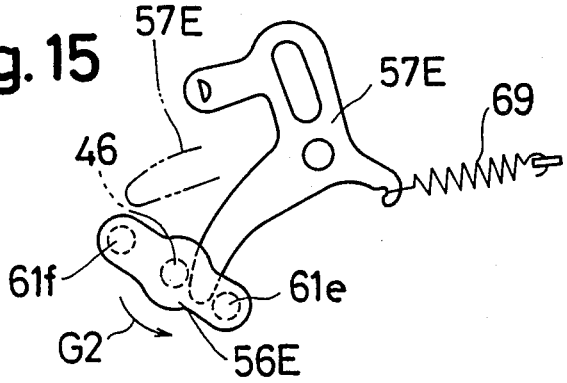
FIG. 15 is a side view of a door closing device of a second embodiment in a second position according to the present invention.

Further, as shown in FIG. 15, the cam-lever 56E is rotated in the direction of arrow G2 so as to push, at its projection 61*e*, the projection 61*e* of the active-lever 57E, thereby moving it to the two-dotted position. When the projection 61*e* is disengaged from the active-lever 57, it is returned to its original position by the actuation of the return spring 69.

The principles, preferred embodiments and modes of operation of the present invention have been described in the foregoing application. The invention which is intended to be protected herein should not, however, be constructed as limited to the particular forms disclosed, as these are to be regarded as illustrative rather than restrictive. Variation and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A door closing device comprising:

a latch mechanism provided between a door and a body and including a striker secured to the body and a pawl provided with the door;

a driving mechanism; and a transmitting mechanism includes a first member to be operated by said driving mechanism and a cam lever, a second member engageable with the first member and acting on the pawl for closing the door upon engagement with the first member, and a cancel-lever for releasing the engagement between the first and second members, said second member comprising a push lever and a slide lever, said driving mechanism driving said cam lever to operate said first member and said push lever to move said door from a half-latched condition to a full-latched condition.

2. A door closing device according to claim 1 wherein the driving source is an electrically operated motor.

3. A door closing device according to claim 1 wherein the cancel-lever is manipulated by either an inside-handle or an outside-handle.

4. A door closing device according to claim 1 wherein the first and the second members are arranged in layers.

5. A door closing device according to claim 1 further including detecting means for detecting said half-latched condition of the door.

6. A door closing device according to claim 5 wherein the detecting means is in the form of a switch.

* * * * *